US007497661B2

(12) United States Patent
Boury et al.

(10) Patent No.: US 7,497,661 B2
(45) Date of Patent: Mar. 3, 2009

(54) GAS TURBINE ROTOR BLADE

(75) Inventors: Jacques Auguste Amedee Boury, Saint Ouen en Brie (FR); Maurice Guy Judet, Dammarie les Lys (FR)

(73) Assignee: SNECMA, Paris (FR)

( * ) Notice: Subject to any disclaimer, the term of this patent is extended or adjusted under 35 U.S.C. 154(b) by 492 days.

(21) Appl. No.: 11/257,151

(22) Filed: Oct. 25, 2005

(65) Prior Publication Data

US 2006/0088416 A1 Apr. 27, 2006

(30) Foreign Application Priority Data

Oct. 27, 2004 (FR) ..... 04 11436

(51) Int. Cl.
*F01D 5/08* (2006.01)

(52) U.S. Cl. ..... 416/97 R; 416/193 A

(58) Field of Classification Search ..... 416/97 R, 416/193 A, 232

See application file for complete search history.

(56) References Cited

U.S. PATENT DOCUMENTS 6,079,946 A * 6/2000 Suenaga et al. ..... 416/97 R
6,120,249 A * 9/2000 Hultgren et al. ..... 416/97 R
6,190,128 B1 * 2/2001 Fukuno et al. ..... 416/96 R
6,190,130 B1 * 2/2001 Fukue et al. ..... 416/97 R
6,196,799 B1 * 3/2001 Fukue et al. ..... 416/97 R
6,210,111 B1 * 4/2001 Liang ..... 416/97 R
6,945,749 B2 * 9/2005 De Cardenas ..... 415/115
7,097,417 B2 * 8/2006 Liang ..... 415/115

FOREIGN PATENT DOCUMENTS

EP 0 945 594 A1 9/1999
EP 1 512 835 A2 3/2005
WO WO 96/13653 5/1996

* cited by examiner

*Primary Examiner*—Edward Look
*Assistant Examiner*—Aaron R Eastman
(74) *Attorney, Agent, or Firm*—Oblon, Spivak, McClelland, Maier & Neustadt, P.C.

(57) ABSTRACT

A rotor blade for a gas turbine, in particular a turbojet, the blade comprising an airfoil, a platform connecting the airfoil to a blade root and having at least one stiffener extending under the downstream portion of the platform, together with means for cooling the blade by a flow of cooling fluid in ducts formed in the blade and in a cavity formed in the stiffener substantially in register with the trailing edge of the blade, and including outlet orifices facing downstream.

13 Claims, 2 Drawing Sheets

GAS TURBINE ROTOR BLADE

The present invention relates to a rotor blade for a gas turbine, in particular a high pressure turbine of a turbojet.

BACKGROUND OF THE INVENTION

In known manner, a gas turbine rotor blade comprises an airfoil formed with a suction or convex outer surface and with a pressure or concave inner surface, which surfaces are interconnected at their upstream ends by a leading edge and at their downstream ends by a trailing edge, where "upstream" and "downstream" are relative to the gas flow direction. The airfoil is connected by a platform to a blade root of the dovetail, Christmas tree, or similar type for insertion in a corresponding cavity of a rotor disk of the gas turbine. At least one reinforcing web, referred to as a "stiffener", is formed at the downstream end of the platform on its side opposite from the airfoil and it extends transversely, being connected to the blade root.

The blade also includes cooling means whereby a fluid such as air flows through ducts that are formed inside the airfoil and the blade root by casting. The cooling air escapes in particular via exhaust slots opening out downstream along the trailing edge and oriented substantially perpendicularly to the longitudinal axis of the blade and parallel to the platform.

The zone where the trailing edge connects with the platform lies between a cooling air exhaust slot and the stiffener, and it is the radially inner portion of the stiffener that is cooled by contact with the cooling air. This connection zone is thus remote from cooling air and it is in contact with the hot gas flowing through the turbine, so it is subjected to intense thermal stresses, leading to the formation of cracks that can destroy the blade and also the turbine.

Proposals have already been made to cool this connection zone by a flow of air leaving through orifices formed in the platform and opening out into the suction surface, but that configuration is not mechanically satisfactory.

OBJECTS AND SUMMARY OF THE INVENTION

A particular object of the invention is to provide a solution to this problem that is inexpensive and effective.

The invention provides a blade of the above-specified type in which the connection zone between the trailing edge and the platform is cooled by limiting the temperature gradient between said connection zone and the stiffener.

To this end, the invention provides a rotor blade for a gas turbine, in particular a turbojet, the blade comprising an airfoil, a platform connecting the airfoil to a blade root, and at least one stiffener formed by a plane web extending from the platform from its side opposite from the airfoil and passing under a trailing edge of the airfoil, together with cooling fluid flow ducts formed in the blade and in the blade root, the blade also comprising cooling means formed in a portion of the stiffener that is adjacent to the platform and that is situated substantially in alignment with the trailing edge of the blade.

Advantageously, said cooling means comprise a cavity formed in the stiffener and connected to a feed duct formed in the blade root and to at least one cooling fluid outlet orifice opening out downstream under the platform.

The cooling cavity formed in the stiffener substantially in register with the trailing edge serves to cool the material situated between said cavity and the connection between the trailing edge and the platform. This leads to a significant reduction in the temperature gradient between said connection and the stiffener, and to a corresponding reduction in the risk of cracks forming at the connection between the trailing edge and the platform.

Advantageously, the outlet orifice(s) of the cavity is/are substantially parallel to the trailing edge. Cooling fluid flowing in the cavity of the stiffener can thus exit without disturbing the flow of gas leaving the blade.

The cavity in the stiffener can be made during casting together with the ducts for conveying the cooling fluid, and the outlet orifices from the cavity can also be obtained during casting when they are of a diameter that is greater than or equal to about 0.6 millimeters (mm), or else they can be made by laser drilling or by electroerosion when they are of a smaller diameter.

To make the cavity easier to form during casting, it is possible to give the stiffener a thickness that is slightly greater than the thickness that is normally provided, with the increase in weight due to this extra thickness being compensated by forming the cavity.

The invention also provides a turbojet turbine including a plurality of blades of the above-specified type, with stiffeners formed with cooling cavities substantially in register with the trailing edges of the blades.

The invention also provides a turbojet, including a turbine as described above.

BRIEF DESCRIPTION OF THE DRAWINGS

Other advantages and characteristics of the invention appear on reading the following description made by way of non-limiting example and with reference to the accompanying drawings, in which.

MORE DETAILED DESCRIPTION

Figure 1:
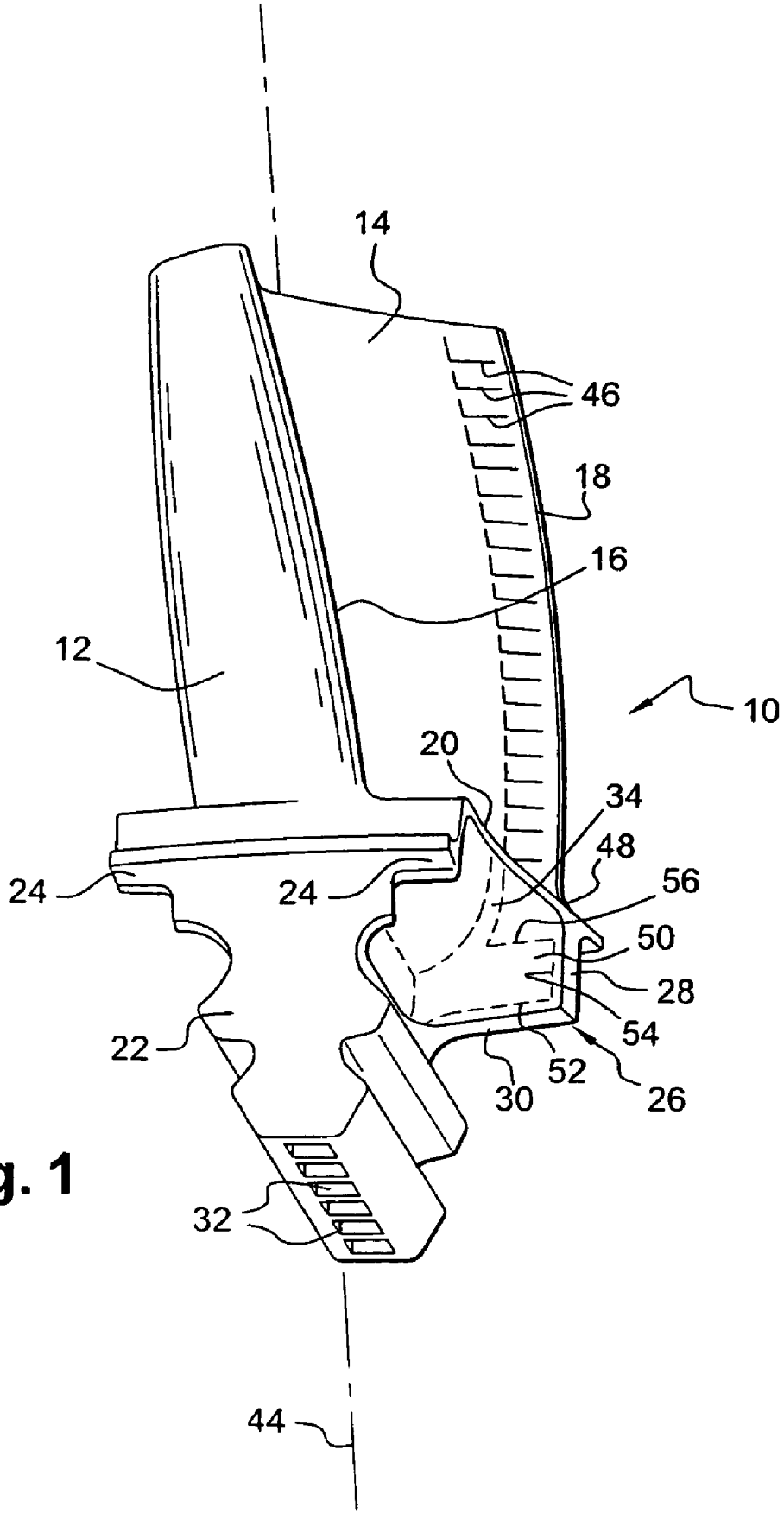
FIG. 1 is a diagrammatic perspective view of a turbine blade of the invention, seen from the upstream side.
Figure 2:
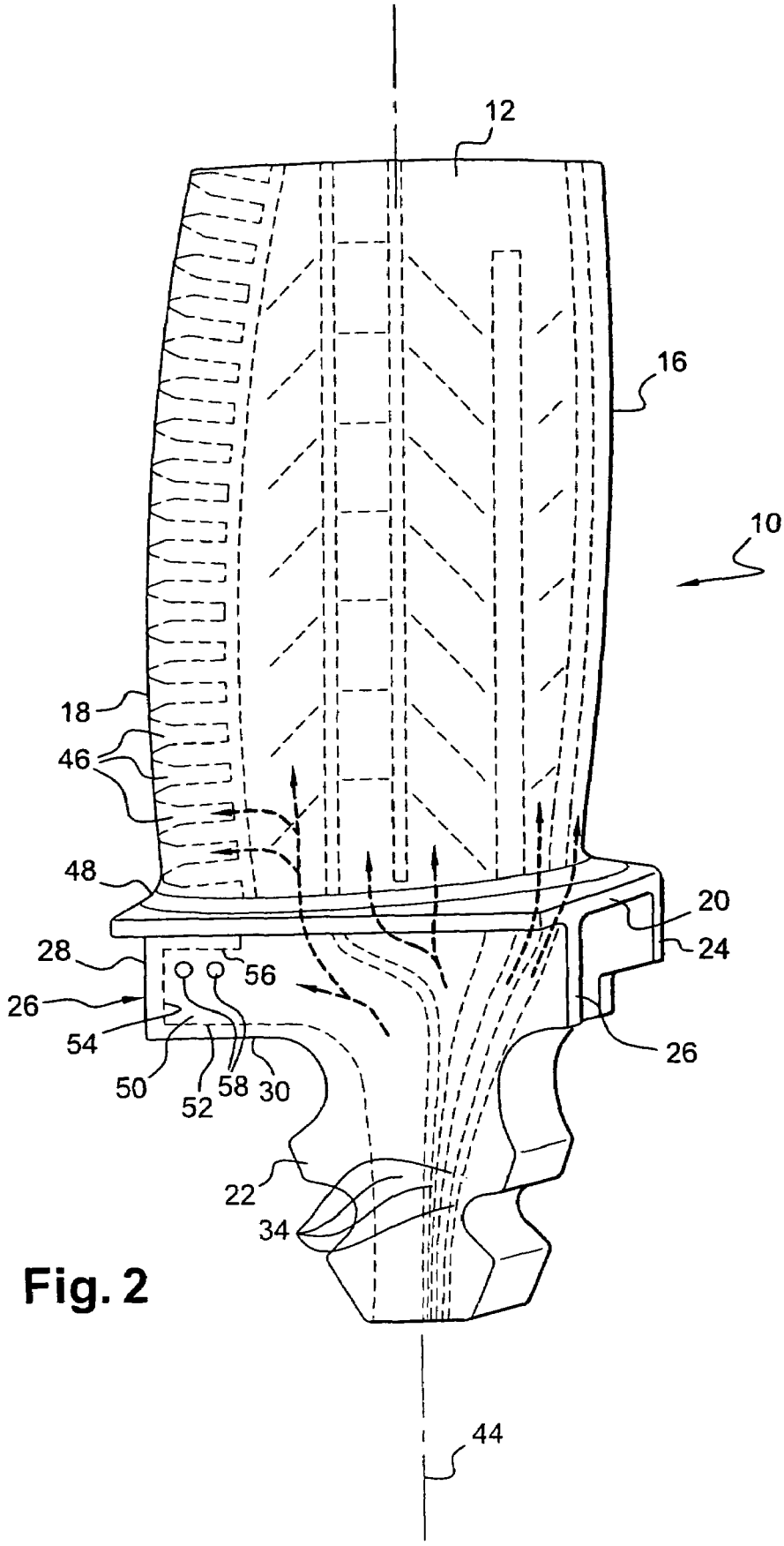
FIG. 2 is a diagrammatic perspective view of the FIG. 1 turbine blade seen from the downstream side.

FIGS. 1 and 2 show a blade 10 of a high pressure stage of a gas turbine, and in particular of a turbojet. This blade 10 comprises an airfoil formed with a suction or convex outer surface 12 and with a pressure or concave inner surface 14, which surfaces are interconnected at their upstream ends by a leading edge 16 and at their downstream ends by a trailing edge 18, where "upstream" and "downstream" are relative to the flow direction of the gas flowing through the turbine.

The blade is connected via a substantially rectangular transverse platform 20 to a blade root 22 whereby the blade 10 is mounted on a disk (not shown) of the rotor of the gas turbine, by engaging said root 22 in a cavity of complementary shape in the periphery of the rotor disk. By means of this male/female engagement, which is of the Christmas tree type in the example shown, the blade 10 is held radially on the rotor disk. Other means are provided for preventing the root 22 of the blade 10 from moving axially in the cavity in the disk. Each rotor disk carries a plurality of blades 10 that are regularly distributed around its outer periphery.

The platform 20 is also connected to the blade root 22 by reinforcing webs 24 and 26, referred to as stiffeners, extending from the platform in the opposite direction to the airfoil at the upstream and downstream ends respectively of the platform 20, in a direction that is substantially perpendicular to the platform 20 and transverse or circumferential relative to the axis of rotation when the blade 10 is mounted on a rotor disk.

The downstream stiffener 26 extends beneath the junction between the trailing edge 18 and the platform 20 and it is connected to the blade root 22. Its lateral edge 28, which is substantially perpendicular to the platform 20, has its radially inner edge 30 connected to a lateral edge of the platform 20 at the junction between the trailing edge 18 and the platform 20.

The upstream and downstream stiffeners 24 and 26 stiffen the platform 20 and prevent it from bending outwards about an axis parallel to the axis of rotation, and between them they define a housing for a sealing liner (not shown) that is arranged under the platform 20 and that extends between said blade 10 and an adjacent blade of the rotor disk.

These sealing liners prevent gas or air from passing from the inner portion of the turbine radially outwards between the platform 20 of adjacent blades, and conversely they prevent gas or air from passing from the outside towards the inner portion of the turbine between the platform 20 of adjacent blades.

The air in the inner portion engages in the orifices 32 of the end face of the blade root 22 and flows into feed ducts 34 formed in the blade root 22 and extending inside the airfoil of the blade 10, as represented by dashed lines in FIG. 2, these ducts being substantially parallel to the longitudinal axis 44 of the blade 10 and serving to cool it. The flow of air along the feed ducts is represented by dashed-line arrows.

The channel 34 situated close to the trailing edge 18 of the blade 10 feeds air exhaust slots 46 shown in FIG. 1 and represented in FIG. 2 by dashed lines, that are formed in a portion of the pressure surface 14 close to the trailing edge 18 and pointing substantially perpendicularly to the longitudinal axis 44 of the blade 10 and parallel to the platform 20.

In operation, the cooling air leaving via the slots 46 in the trailing edge 18 cannot cool the connection 48 between the trailing edge 18 and the platform 20, which edge is in contact with the hot gas and is subjected to high levels of thermal stress. The invention provides a reduction in this stress by reducing the vertical temperature gradient between the downstream stiffener 26 and the connection 48 between the trailing edge 18 and the platform 20. To do this, a cavity 50 is formed in the stiffener 26 substantially in register with the trailing edge 18, and communicates both with a cooling air feed duct 34 and with cooling air outlet means.

In the embodiment of FIGS. 1 and 2, the cavity 50 is substantially in the form of a rectangular parallelepiped, having an inner edge 52 close to the inner edge 30 of the stiffener 26 and substantially parallel thereto, a lateral edge 54 close to the lateral edge 28 of the stiffener 26 and substantially parallel thereto, and an outer edge 56 substantially adjacent to the platform 20. The cavity 50 is directly connected to the duct 34 for feeding the exhaust slots 46 with cooling air.

The cavity 50 is connected to the outside via one or more orifices 58 opening out downstream under the platform, thus enabling air to flow continuously inside the cavity 50 and cool the material situated between said cavity 50 and the connection 48 between the trailing edge 18 and the platform 20. The flow of air in the cavity 50 and its exhaust via the orifices 58 transfers and eliminates heat from the material between the cavity 50 and the connection 48 of the trailing edge 18, thereby cooling this connection 48 by conduction.

The orifices 58 may be of arbitrary shapes and sizes. They may be formed in the downstream face of the stiffener 26.

Typically, for a high-pressure turbine blade that is about 50 mm tall, the cavity 50 has a length in the transverse circumferential direction of about 5 mm to 6 mm, a height along the axis 44 of the blade that is about 3 mm, and a thickness along the axis of rotation that is 1 mm or less, e.g. being about 0.8 mm.

This cavity 50 is advantageously made by casting. In order to avoid weakening the downstream stiffener 26 of the blade 10, its thickness may be increased, with the increase in weight due to this increase in thickness being compensated by forming the cavity 50.

The orifices 58 are made by casting, by laser drilling, or by electroerosion, where the laser drilling and electroerosion techniques take the place of casting when it is necessary to make orifices having a diameter of less than about 0.6 mm.

What is claimed is:

1. A rotor blade for a gas turbine, the blade comprising:

an airfoil having a trailing edge and a leading edge, said airfoil defining airfoil cooling fluid ducts, a blade root defining root cooling fluid ducts that are in fluid communication with said airfoil cooling fluid ducts, a platform connecting the airfoil to the blade root, at least one stiffener between said platform and said blade root and including a plane web extending from the platform from its side opposite from the airfoil and passing under the trailing edge of the airfoil, and a cooling cavity formed in a trailing edge portion of the plane web of the stiffener, said trailing edge portion being adjacent to the platform and being situated substantially in alignment with the trailing edge of the airfoil, said cavity being in fluid communication with at least one of said root cooling fluid flow ducts formed in the blade root.

2. A blade according to claim 1, wherein said cavity is in fluid communication with at least one cooling fluid outlet orifice opening out downstream under the platform.

3. A blade according to claim 2, wherein the at least one outlet orifice from the cavity is oriented substantially parallel to the trailing edge of the blade.

4. A blade according to claim 2, wherein, when the blade is a blade for a high-pressure stage, the cavity of the stiffener presents dimensions of a few millimeters along the axis of the blade and in a direction perpendicular to said axis and to the axis of rotation of the turbine, and of about 1 mm or less in a direction that is perpendicular to the two above-specified directions.

5. A blade according to claim 2, wherein the cavity of the stiffener is made during casting.

6. A blade according to claim 2, wherein the at least one outlet orifice from the cavity is made during casting or by laser drilling or by electroerosion.

7. A blade according to claim 2, wherein said stiffener is a downstream stiffener, said blade further comprising an upstream stiffener, wherein said cavity is formed only in said downstream stiffener and not in said upstream stiffener.

8. A blade according to claim 7, wherein said upstream and downstream stiffeners define a housing for a sealing line that prevents air from passing radially outwards and inwards between platforms of adjacent blades.

9. A blade according to claim 2, wherein said at least one of said root cooling fluid flow ducts, which is in fluid communication with said cavity, is in further fluid communication with air exhaust slots formed in a trailing edge portion of a pressure surface of said airfoil.

10. A blade according to claim 9, wherein said cavity is substantially a rectangular parallelepiped.

11. A turbojet turbine, including a plurality of blades according to claim 1.

12. A turbojet, including a turbine according to claim 11.

13. A rotor blade for a gas turbine, the blade comprising:

an airfoil having a trailing edge and a leading edge, said airfoil defining airfoil cooling fluid ducts, a blade root defining root cooling fluid ducts that are in fluid communication with said airfoil cooling fluid ducts, a platform connecting the airfoil to the blade root, said platform being connected to the trailing edge of the airfoil at a trailing edge connection, at least one stiffener between said platform and said blade root and including a plane web extending from the platform from its side opposite from the airfoil and passing under the trailing edge of the airfoil, and cooling means for reducing a temperature gradient between the trailing edge connection and the stiffener, said cooling means being formed in a trailing edge portion of the plane web of the stiffener, said trailing edge portion being adjacent to the platform and being situated substantially in alignment with the trailing edge of the airfoil, said cooling means being in fluid communication with at least one of the root cooling fluid flow ducts formed in the blade root.

* * * * *